United States Patent [19]

Ochi et al.

[11] Patent Number: 5,014,635

[45] Date of Patent: May 14, 1991

[54] DEVICE FOR CONTROLLING FEEDING QUANTITY OF A SEWING MACHINE

[75] Inventors: Moriya Ochi; Masahiro Sahashi, both of Toyota, Japan

[73] Assignee: Aisin Seiki Kabushiki Kaisha, Kariya City, Japan

[21] Appl. No.: 440,715

[22] Filed: Nov. 24, 1989

[30] Foreign Application Priority Data

Nov. 29, 1988 [JP] Japan ..... 63-302102
Nov. 29, 1988 [JP] Japan ..... 63-302103

[51] Int. Cl.[5] ..... D05B 27/06; D05B 27/08

[52] U.S. Cl. ..... 112/311; 112/313; 112/320

[58] Field of Search ..... 112/311, 312, 313, 314, 112/315, 320

[56] References Cited

U.S. PATENT DOCUMENTS

| | | | |
|---|---|---|---|
| 2,941,487 | 6/1960 | Winz | 112/311 |
| 3,160,127 | 12/1964 | Orth et al. | 112/313 |
| 3,174,449 | 3/1965 | Bono | 112/313 |
| 3,202,121 | 8/1965 | Orth et al. | 112/313 |
| 3,368,507 | 2/1968 | Orth | 112/311 |
| 3,605,662 | 9/1971 | Willenbacher et al. | 112/320 X |
| 3,954,071 | 5/1976 | Mall et al. | 112/311 |
| 4,143,607 | 3/1979 | Hager | 112/313 |
| 4,503,794 | 3/1985 | Ishibara et al. | 112/313 |
| 4,777,896 | 10/1988 | Nomura | 112/320 X |
| 4,848,254 | 7/1989 | Krowatchek et al. | 112/320 X |

FOREIGN PATENT DOCUMENTS

| | | | |
|---|---|---|---|
| 57077 | 11/1988 | Japan | 112/313 |

*Primary Examiner*—Peter Nerbun
*Assistant Examiner*—Paul C. Lewis
*Attorney, Agent, or Firm*—Oblon, Spivak, McClelland, Maier & Neustadt

[57] ABSTRACT

A device for controlling feeding quantity of a sewing machine includes a driver for driving an upper feed-dog and a lower feed-dog, a first setter for setting the feeding quantity of the lower feed-dog, a second setter for setting a ratio of the feeding quantity of the upper feed-dog to that of the lower feed-dog, a first adjuster for adjusting the feeding quantity of the lower feed-dog based on the set value at the first setter, and a second adjuster for adjusting the feeding quantity of the upper feed-dog based on the set value at the first setter and the ratio set at the second setter.

7 Claims, 4 Drawing Sheets

DEVICE FOR CONTROLLING FEEDING QUANTITY OF A SEWING MACHINE

BACKGROUND OF THE INVENTION

1. Field of the Invention

The present invention relates to a device for controlling the feeding quantity of a sewing machine.

2. Description of the Related Art

A conventional device of the type is disclosed, for example, in Japanese Utility Model Publication 57-13005 published in 1982. In the conventional device, two cloth layers to be sewn are respectively fed by an upper feed-dog and a lower feed-dog. The feeding quantity of the upper feed-dog is the same as that of the lower feed-dog under the normal operation mode sewing.

However, in the conventional device, when the feeding quantity of the upper feed-dog has to be changed due to a change of the needle-numbers, a changing or adjusting operation of the feeding quantity of the upper feed-dog and a changing or adjusting operation of the feeding quantity of the lower feed-dog have to be separately performed. Such operations are cumbersome for an operator of the machine.

SUMMARY OF THE INVENTION

It is, therefore, a principal object of the present invention to provide a device for controlling feeding quantity of a sewing machine without the foregoing drawback.

It is another object of the present invention to provide a device for controlling feeding quantity of a sewing machine wherein the feeding quantity of the lower feed-dog is kept the same as that of the upper feed-dog despite any change of the feeding quantity thereof.

To this end, according to the present invention, a device for controlling feeding quantity of a sewing machine is comprised of a driving means for driving an upper feed-dog and a lower feed-dog, a first setting means for setting the feeding quantity of the lower feed-dog, a second setting means for setting a ratio of the feeding quantity of the upper feed-dog to that of the lower feed-dog, a first adjusting means for adjusting the feeding quantity of the lower feed-dog based on the set value at the first setting means, and a second adjusting means for adjusting the feeding quantity of the upper feed-dog based on the set value at the first setting means and the ratio set at the second setting means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
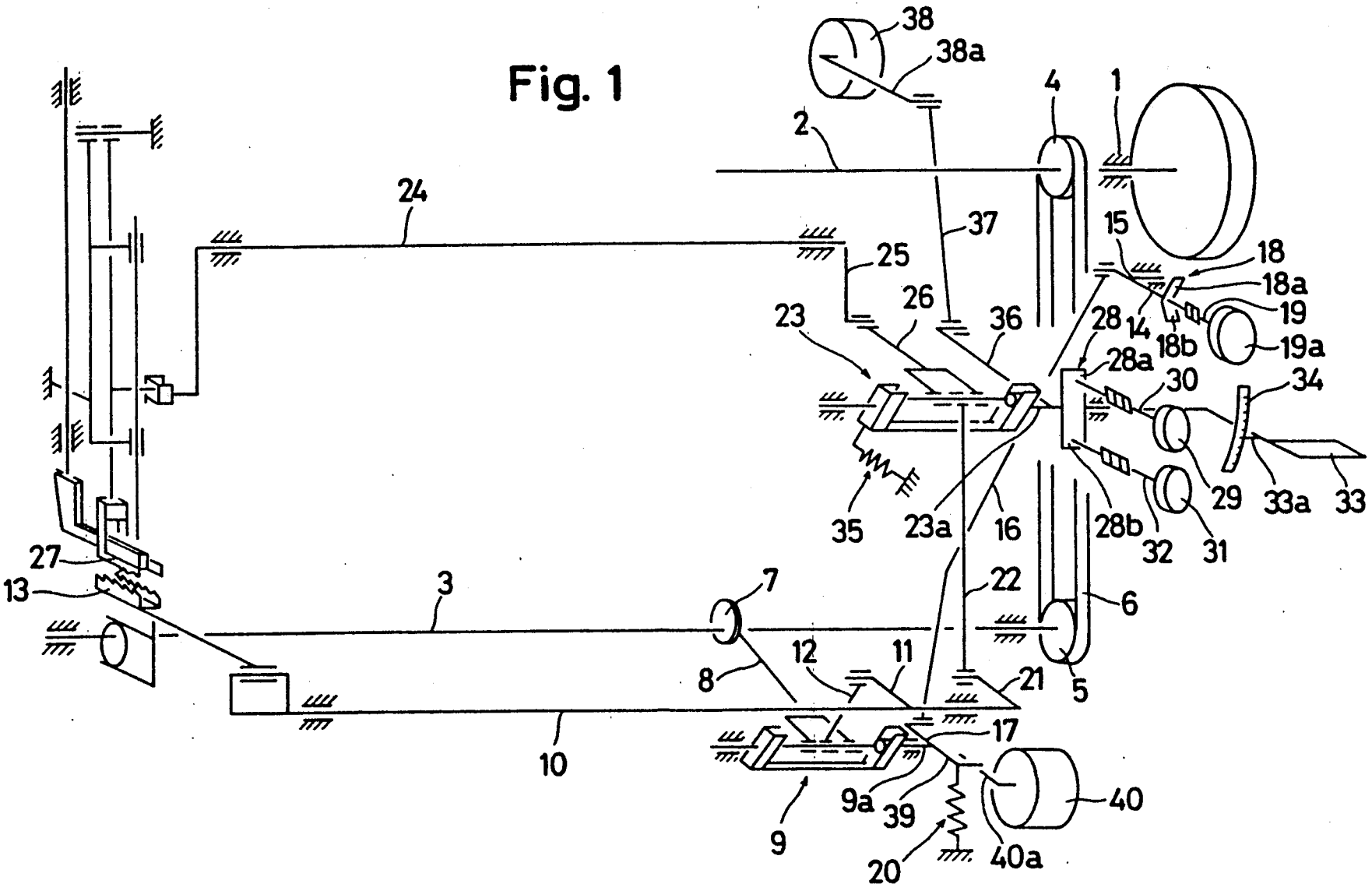
FIG. 1 is a schematic illustration of a mechanism of a sewing machine to which the present invention is applied.
Figure 2:
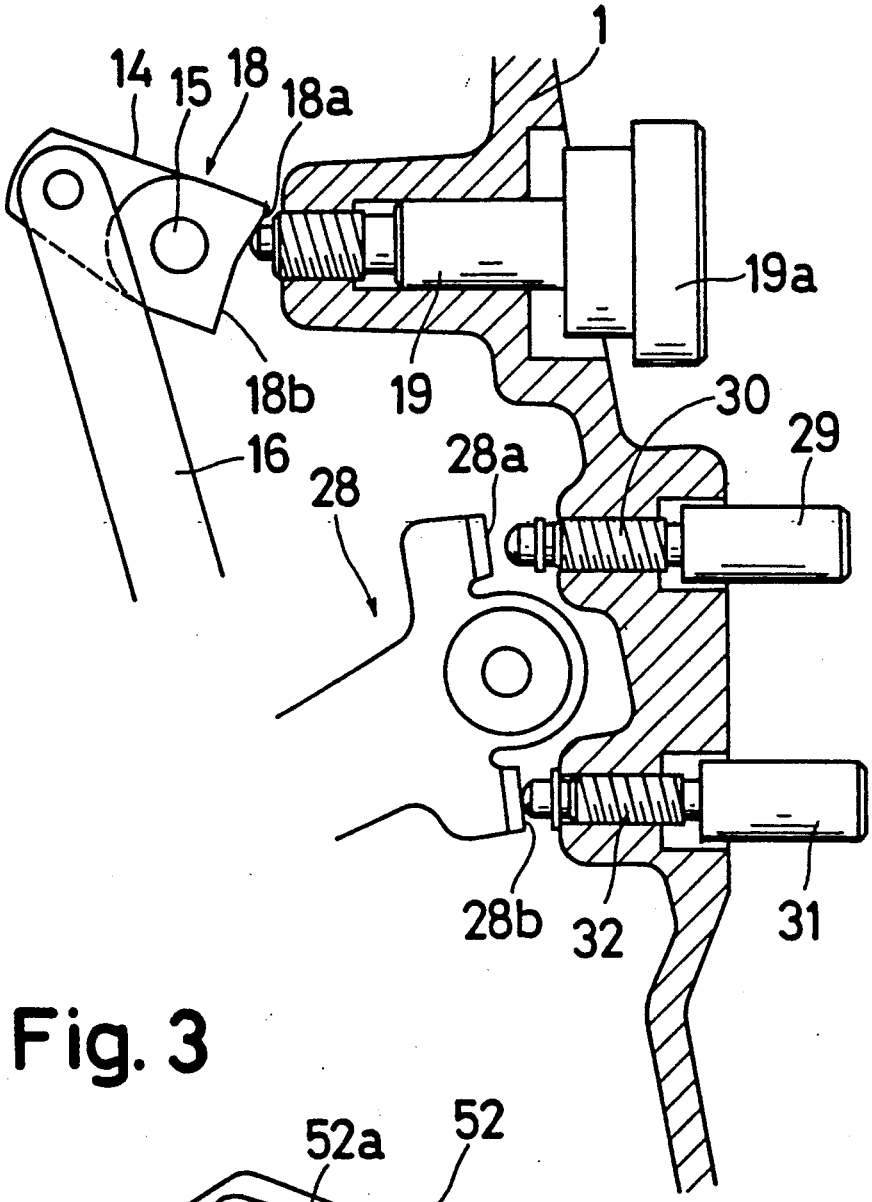
FIG. 2 shows a main portion of the mechanism shown in FIG. 1.

Referring now to FIGS. 1 and 2, an upper shaft 2 and a lower shaft 3 arranged in parallel relationship are rotatably mounted on a frame 1 of a sewing machine. A timing-pulley 4 and a timing-pulley 5 are secured to the upper shaft 2 and the lower shaft 3, respectively, and are operatively connected by a timing-belt 6.

A feeding cam 7 is fixedly mounted on the lower shaft 3 and is operatively connected, via a horizontal feed rod 8, to a conventional lower feed regulator 9.

Within a lower portion of the frame 1, a horizontal feed shaft 10 is rotatably mounted to the frame so as to be in parallel relationship with the lower shaft 3. An arm 11 is secured to the shaft 10 so as to extend perpendicular thereto and is pivotally connected to a link 12 connected to the lower regulator 9. A conventional lower feed-dog 13 is secured to a left end of the lower shaft 3.

A feed control member 14 is pivoted to the frame 1 via a pin 15 and is arranged perpendicular to the upper shaft 2. One end of the member 14 is pivotally connected to a rod 16 whose other end is pivotally connected to an operating arm 17 which is transversely connected to a pivot **9*a* of the lower feed regulator 9. On the other hand, a controlling surface 18 is formed on the other end of the member 14 and is in abutment with a threaded shaft 19 of a rotating dial 19*a* as a first setting means for indicating a quantity corresponding to the feeding quantity of the lower feed-dog 13. In addition, the surface 18 is divided into an upper face 18*a* and a lower face 18*b* which extend obliquely to the member 14, i.e., they are not tangent to a circle centered on the pin 15, and the former is biased continually into abutment with the shaft 19 by a spring 20 which is disposed between the first feed regulator 9 and the frame 1. Rotation of the dial 19*a* moves the shaft 19 axially. Since the upper face 18*a* extends obliquely with respect to the member 14, axial movement of the shaft 19 causes the member 14 to pivot as the point of contact of the shaft 19 moves along the length of the upper face 18*a***.

An operating arm 21 is secured at the right end of the shaft 10 so as to form an angle of 90 degrees relative thereto and is connected, via rod 22, to an upper feed regulator 23 which is pivoted to the frame. Thus, both feed regulators 9 and 23 are linked with the sewing operation via the common cam 7 and the rod 22. A projection of arm 17 is secured to the pivot **9*a* so as to be perpendicular thereto, is oriented in the opposite direction of the arm 17 and is connected to a plunger 40*a* of a rotary solenoid 40**.

An upper feed shaft 24 is rotatably mounted on the frame so as to be in parallel relationship to the upper shaft 2. A swing arm 25 is secured to one end of the shaft 24 so as to be perpendicular thereto and is pivotally connected, via a rod 26, to the upper feed regulator 23. A known upper feed-dog 27 is secured to the other end of the shaft 24.

A control surface 28, including an upper face **28*a* and a lower face 28*b*, is mounted on the rotatable pivot 23*a*. The upper face 28*a* and the lower face 28*b* are respectively, engageable with a distal end of a first adjust shaft 30 and a distal end of a second adjust shaft 32. The first adjust shaft 30 and the second adjust shaft 32 are threadably passed through the frame 1. The ends thereof extended outside of the frame are respectively provided with a dial 29 and a dial 31. A spring 35** biases the upper regulator 23 to maintain the engagement between the lower face 28*b* and the shaft 32. The dials 29 and 31 constitute a second setting means. That is, by rotation of the dials, the positions of the shafts 30 and 32 are axially adjusted to pivot the pivot 23*a*.

A manual level 33 with a pointer 33*a* is located outside of the frame 1 and is connected to the pivot 23*a*. The pointer 33*a* is in opposition to a scaled-plate 34 for showing the feed ratio of the upper feed-dog 27 to the lower feed-dog 13. A projected arm 36 is secured to the pivot 23*a* so as to make an angle of 90 degrees relative thereto and is pivotally connected, via a rod 37, to an arm 38*a* of a rotary solenoid 38.

Figure 4:
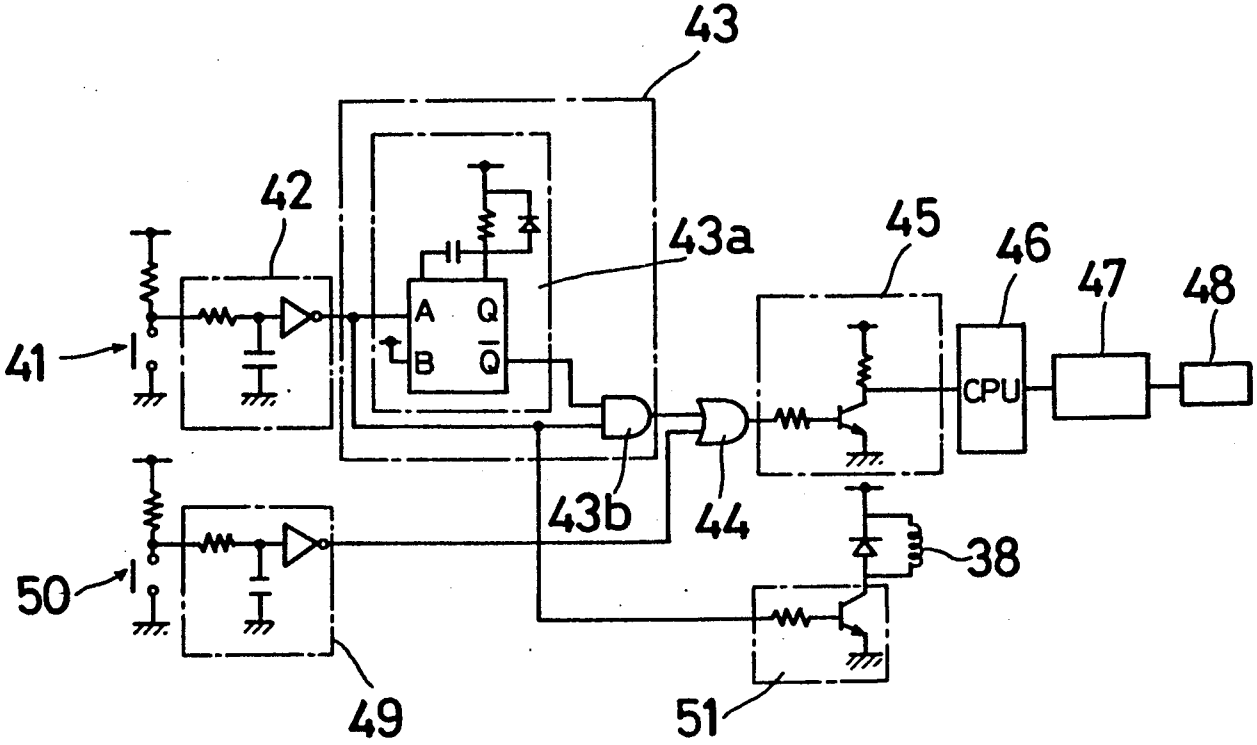
FIG. 4 shows a circuit for driving the mechanism shown in FIG. 1.

As shown in FIG. 4, a differential operation switch 41 and a chattering-prevention circuit 42 are connected to a multivibrator 43*a*. The chattering-prevention circuit 42 and the multivibrator 43*a* are respectively connected to the input terminals of an AND-Gate 43*b*. The multivibrator 43*a* and the AND-Gate 43*b* constitute a delay circuit 43. Further, an output terminal of the AND-Gate 43*b* is connected to one of input terminals of an OR-gate 44. The OR-gate 44, an inverter circuit 45, a CPU 46, a driving circuit 47 and a motor 48 are connected in turn. The rotational number of the motor 48 is controlled by the CPU. The other input terminal of the OR-gate 44 is connected, via the chattering-prevention circuit 49, with a normal or ordinal operation switch 50. Further, the output terminal of the chattering-prevention circuit 42 is connected via a solenoid driving circuit 51 to the rotary solenoid 38 and is connected to the other input terminal of the AND-gate 43*b*.

Figure 3:
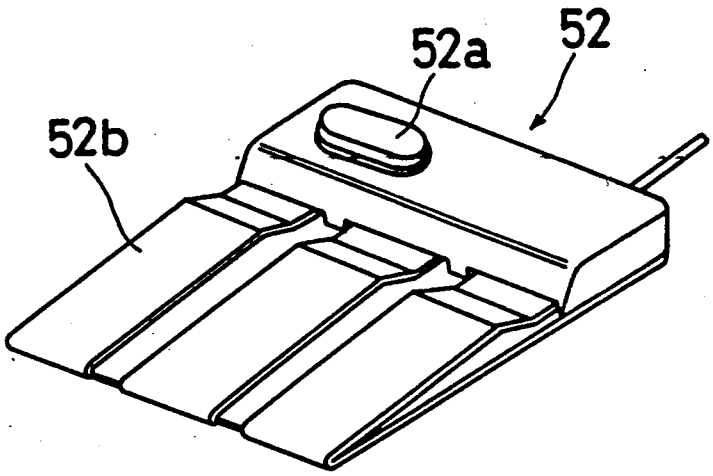
FIG. 3 shows a perspective view of a foot-switch.

It is noted that the differential operation switch 41 and the normal or ordinal operation switch 50 are actuated by a pedal 52*a* and a pedal 52*b* of a foot-switch 52, respectively as shown in FIG. 3.

In operation, when normal operation is selected, first of all, the dial 19*a* is rotated by an angle corresponding to the desired feeding quantity. This rotation is transmitted, via the member 18 and the pivoting of the rod 16 and the arm 17, to the lower feed regulator 9, thereby rotating the lower feed regulator 9 against the spring 20. Thus, the feeding quantity of the lower feed-dog 13 is adjusted. Next, when the pointer 33*a* is coincided with a "1" on the scaled-plate 34 so that the ratio of the feeding quantity of the upper feed-dog 27 to that of the lower feed-dog 13 is set at 1, the surface 28 is rotated and the upper feed regulator 23 is rotated at an angle against the spring 35. Thus, despite any variation of the feeding quantity of the lower feed-dog by the rotation of the dial 19*a*, the feeding quantities of both feed-dogs 13 and 27 will be the same due to rod 22. Under this condition, upon depression or actuation of the pedal 52*b* of the foot switch 52, the motor 48 is driven and the sewing machine is brought into operation. In this embodiment, while the pedal 52*b* is being depressed, the sewing machine operates. When the pedal 52*b* is released, the motor 48 is stopped. In the event the advance or delay of the upper feed-dog 27 is desired, by manipulating the dial 31, the correction for delaying or advancing the upper feed-dog 27 can be obtained.

Next, when the sewing is desired to the gathering mode under which the feeding quantity of the upper feed-dog 27 is larger than that of the lower feed-dog 13, first of all the shaft 30 is brought into abutment with the upper face 28*a* of the member 28 by rotating the pivot 23*a* via the manual level 33. In addition, due to a rotation of the member 28 through an angle as a result of the rotation of the dial 29 to set a desired ratio of the feed quantity of the upper feed-dog 27 to that of the lower feed-dog 13, the upper feed regulator 23 is rotated, thereby setting the feeding quantity of the upper feed-dog 27 according to the determined ratio. Under this condition, when the pedal 52*a* of the foot switch is depressed, the rotary solenoid 38 is actuated, thereby rotating the pivot 23*a* via the rod 37 and the arm 36. This rotation is stopped when the face 28*a* is abutted to the shaft 30. Thereafter, the gathering mode sewing is performed.

It is noted that (1) the sewing can be changed from the normal mode to the gathering mode by depressing the pedal 52*a*, (2) the sewing can be changed from the normal mode to the gathering mode by also manipulating the lever 33 while the pedal 52*b* is being depressed and (3) a check as to whether the present operation mode is normal mode or gathering mode can be performed by observation of the manual lever.

The rotary solenoid 40 can be actuated for pivoting the arm 17, which operates the regulator 9 to adjust the lower feed-dog 13.

Figure 5:
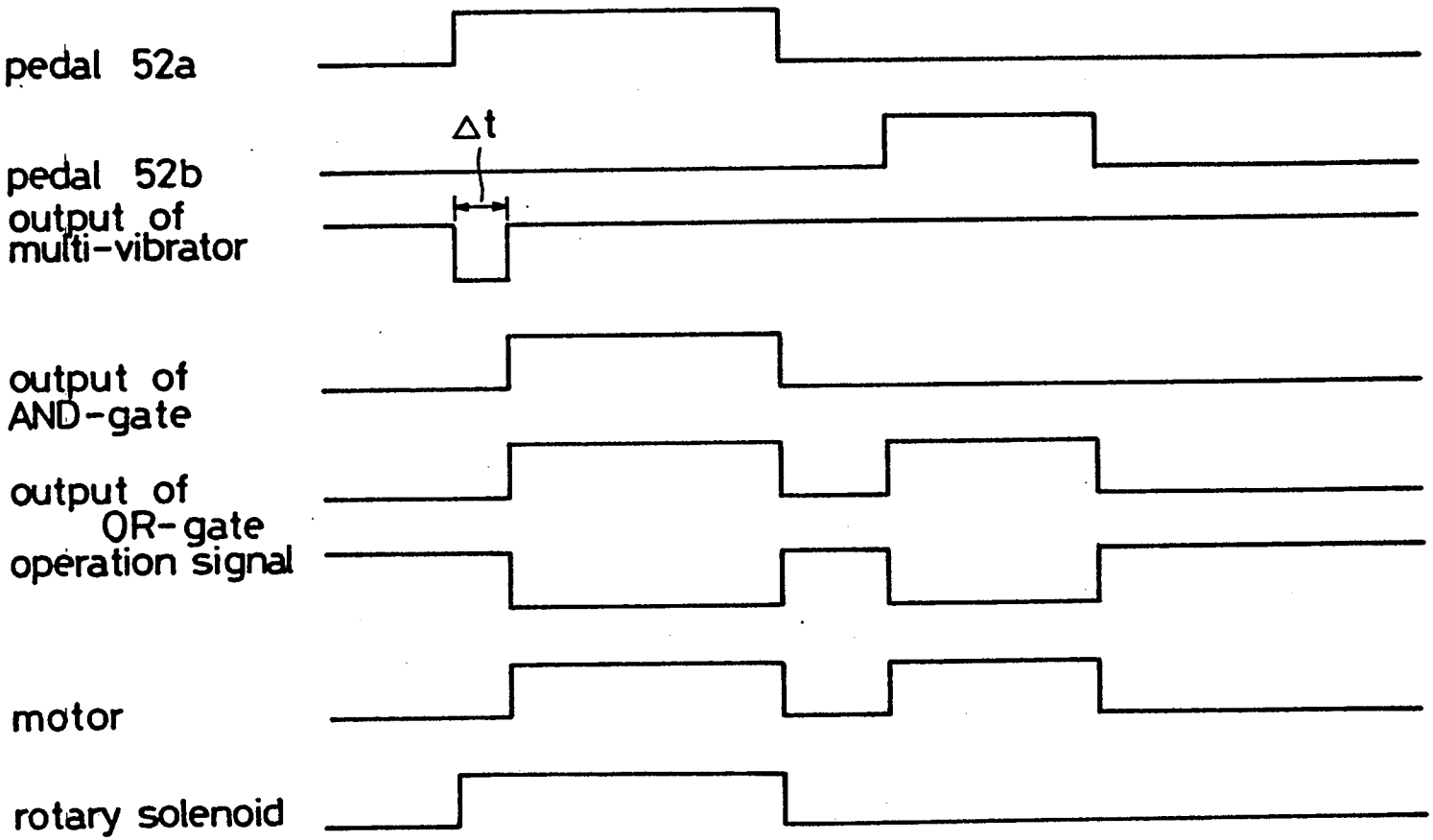
FIG. 5 shows a time-chart for the circuit shown in FIG. 4.

As seen from FIG. 5, showing a time-chart of the circuit of the sewing machine wherein the normal mode sewing operation is performed after the gathering mode sewing operation, the motor 48 is driven when a time of $\Delta t$ has passed after the depression of the pedal 52*a*. During the time of $\Delta t$, the engagement of the face 28*a* with the shaft 30 is perfectly completed, thereby enabling the perfect gathering mode sewing operation.

Although the invention has been described in its preferred form with a certain degree of particularity, it is to be understood that many changes and variations are possible in the invention without departing from the scope and spirit thereof.

What is claimed as new and desired to be secured by letters patent of the United States is:

1. A device for controlling feeding quantity of a sewing machine, comprising:

driving means for driving an upper feed-dog and a lower feed-dog;

first setting means for setting a set value of the feeding quantity of the lower feed-dog;

second setting means for setting a ratio of the feeding quantity of the upper feed-dog to that of the lower feed-dog;

first adjusting means for adjusting the feeding quantity of the lower feed-dog based on the set value at the first setting means; and second adjusting means for adjusting the feeding quantity of the upper feed-dog based on the set value at the first setting means and the ratio set at the second setting means, wherein said first adjusting means comprise:

(a) a feed control member pivoted about a pivot axis and operatively connected to the lower feed-dog for adjusting the feeding quantity of the lower feed-dog as a function of a pivot position of the feed control member, (b) a controlling surface fixed to said pivoted feed control member and having at least one face extending oblique to said pivoted feed control member and non-tangent to a circle centered on the pivot axis of said feed control member, (c) a threaded shaft mounted such that an end of said threaded shaft can abut said at least one face, (d) a rotating dial mounted to said threaded shaft, and (e) spring means for biasing said at least one face against said end of said threaded shaft, whereby axial movement of said threaded shaft due to rotation of said rotating dial causes pivoting of said feed control member and adjustment of the feeding quantity of said lower feed-dog.

2. A device for controlling feeding quantity of a sewing machine according to claim 1 wherein said second setting means comprises means for making the ratio variable.

3. A device for controlling feeding quantity of a sewing machine according to claim 1 wherein said second setting means comprises means for making the ratio vary from 1 to a desired value in such manner that the feeding quantity of the upper feed-dog is at least equal to that of the lower feed-dog.

4. A device for controlling feeding quantity of a sewing machine comprising:

a driving means for driving an upper feed-dog and a lower feed-dog;

a first switch;

a second switch; and controller means for bringing the driving means into a first sewing operation mode wherein the feeding quantity of the upper feed-dog is equal to that of the lower feed-dog when the first switch is closed and bringing the driving means into a second sewing operation mode wherein the feeding quantity of the upper feed-dog is larger than that of the lower feed-dog when the second switch is closed in such manner that the second sewing operation mode is initiated after a predetermined time after the closure of the second switch.

5. The device according to claim 1 wherein said controlling surface has two of said faces.

6. The device according to claim 1 wherein said second adjusting means comprise:

(f) a pivot shaft connected to the upper feed-dog for adjusting the feeding quantity of the upper feed-dog as a function of a pivot position of the pivot shaft, (g) a second control surface having at least one face, (h) a threaded shaft for each of said at least one face of said second control surface and mounted such that an end thereof abuts a respective one of said at least one face, and (i) a rotating dial mounted to each said threaded shaft of said second adjusting means.

7. The device according to claim 6 including solenoid means for automatically pivoting said pivot shaft of said second adjusting means.

* * * * *